US005385447A

United States Patent [19]

Geister

[11] Patent Number: 5,385,447

[45] Date of Patent: Jan. 31, 1995

[54] AXIAL FLOW PUMP FOR DEBRIS-LADEN OIL

[75] Inventor: Donald E. Geister, Ann Arbor, Mich.

[73] Assignee: Marine Pollution Control, Detroit, Mich.

[21] Appl. No.: 38,729

[22] Filed: Mar. 26, 1993

[51] Int. Cl.[6] ..... F04D 3/00

[52] U.S. Cl. ..... 415/220; 415/208.2; 417/424.1

[58] Field of Search ..... 417/405, 406, 424.1, 417/424.2; 415/182.1, 208.2, 208.3, 211.2, 220

[56] References Cited

U.S. PATENT DOCUMENTS

| | | | |
|---|---|---|---|
| 1,974,107 | 10/1934 | Hait | 415/208.2 |
| 2,824,520 | 2/1958 | Bartels | 417/424.1 |
| 3,398,694 | 8/1968 | Lerch | 415/208.2 |
| 4,063,849 | 12/1977 | Modianos | 415/182.1 |
| 4,932,848 | 6/1990 | Christensen | 417/414 |

FOREIGN PATENT DOCUMENTS

| | | | |
|---|---|---|---|
| 0490846 | 6/1992 | European Pat. Off. . | |
| 900350 | 1/1990 | Norway . | |
| 0849744 | 10/1960 | United Kingdom | 415/211.2 |
| 0922323 | 4/1982 | U.S.S.R. | 415/182.1 |

OTHER PUBLICATIONS

Technical Manual for CCN 150-5C, Kvaener-Eureka; Oct. 1992.

*Primary Examiner*—Edward K. Look
*Assistant Examiner*—Mark Sgantzos
*Attorney, Agent, or Firm*—Krass & Young

[57] ABSTRACT

An axial flow pump for handling debris-laden viscous fluid flow, for example of the type encountered in cleaning up oil spills in off-loading stricken oil tankers. The pump includes a bell- or venturi-shaped intake, rotating impeller mounted in the intake, a fixed stator downstream of the impeller, and suitable hydraulic motor means for rotating the impeller to pull oil through the pump from the intake inlet to an outlet. The surface of the intake is specially contoured at a first region from the inlet to the throat or impeller face to reduce and compensate for cavitation and viscous boundary layer growth in that region. A second portion of the intake from the throat or impeller face to the impeller exit is also specially contoured to compensate for viscous boundary layer growth, but modified in view of the impeller-generated forces and debris concentrations in that region which affect viscous boundary layer growth. The impeller/stator blade interface includes a specially-contoured outer region to prevent debris-jamming at the interface.

10 Claims, 6 Drawing Sheets

AXIAL FLOW PUMP FOR DEBRIS-LADEN OIL

FIELD OF THE INVENTION

The present invention is related to axial flow pumps for pumping viscous liquids such as oil, and more particularly to an axial flow pump designed especially for the handling of multi-phase, i.e. debris-laden, viscous flow often encountered cleaning up oil spills and off-loading stricken oil tankers.

BACKGROUND OF THE INVENTION

The transportation of oil by tankers, and thee increasing concern in recent years for limiting the effects of oil spills resulting from tanker mishaps, have resulted in a highly specialized industry centered around the off-loading or pumping of oil from stranded or stricken tankers. The unique environmental factors and risks found in such situations have resulted in the development of portable, lightweight, compact, explosion-proof and corrosion-resistant pumping units which can be delivered to the scene of an accident and efficiently handled on-site.

One such pump is the Kvaerner-Eureka CCN150-5C. It is an axial flow pump in that the pump impeller directs flow primarily axially, rather than radially, through the pump. It essentially consists of a cylindrical pump housing having a venturi-shaped suction bell or intake, a bladed impeller mounted to rotate within the intake, a fixed stator assembly whose blades are opposed to those of the impeller to take the torque out of the liquid flow, and a hydraulic motor for driving the impeller. The entire unit is a compact, cylindrical package designed to be lowered through a standard 12-½ inch Butterworth opening or hatch in oil tankers. The pump is lowered intake-first into the oil or other liquid to be pumped, and the impeller is hydraulically driven to pull oil through the intake, the impeller and the stator for removal by suitably connected hose or tubing.

Although prior art pumps such as the one described above have been adequate for the pumping of high viscosity fluids such as oil, they have been found less than ideal for what is known in the art as "multi-phase flow"; i.e., flow in which the high viscosity fluid being pumped is laden with one or more types of debris. For example, in a typical oil spill situation the oil being pumped can be expected to include kelp, pieces of wood, rock, bits of metal and other debris. Put simply, prior art axial flow pumps have not been adequately designed to efficiently handle the multi-phase flow encountered in real-life pumping situations.

SUMMARY OF THE INVENTION

To efficiently handle debris-laden viscous fluid flow through an axial flow pump, it has been determined in arriving at the present invention that three areas of the pump structure are particularly critical: the contour of the intake; the impeller/stator blade interface region and, the radial spacing or gap between the impeller blades and the intake surface.

The present invention is an axial flow pump having a venturi-shaped intake with an inlet opening, an impeller mounted in the intake and extending from the intake throat toward the outlet, a fixed stator mounted downstream of the impeller, and a motor means for rotating the impeller. The pump intake is specially contoured from the inlet opening to the impeller exit to reduce cavitation and to compensate for viscous boundary layer build-up in multi-phase flow.

In one embodiment, the specially contoured intake has a first contoured portion from the intake inlet to the throat or area of minimum diameter, and a second contoured portion in the region of the impeller. The impeller face is located near the intake throat, and the second contoured portion generally corresponds to the region of the impeller blades. The contour of the first contoured portion is primarily flow- and debris-dependent, while the contour of the second contoured portion is flow-, debris-, and impeller-dependent.

In a particular embodiment the first contoured portion of the intake, from the inlet to the throat, has a radius equal to or greater than the axial distance from the inlet to the throat. In a preferred form, this initial radius is decreased by the multiphase viscous boundary layer growth along the first contoured portion, determined as a function of the viscosity range expected from the liquid to be pumped, as well as the maximum flow rates expected in this region. An nth power law can be used to determine boundary layer growth or buildup.

The second contoured portion of the intake, from the throat to the impeller exit, has a flow-expanding radius greater than the axial length of the impeller. In a preferred form this initial radius is decreased by the boundary layer growth along the second contoured portion. An nth power law can also be used to determine boundary layer buildup in this region, in view of the effects of impeller forces and debris concentration in the boundary layer growth in this region.

The impeller blade contour matches as closely as possible the second contoured portion of the intake, with a radial gap or tolerance between the impeller blade and the intake surface being substantially less than the smallest debris expected to be encountered. This is contrary to the prior art teaching that debris-handling is best achieved by a wide gap or tolerance between the impeller blade and the intake surface. Instead, the minimal tolerance or gap between impeller blade and intake surface in the present invention has been found to reduce or eliminate the incidence of debris-jamming and damage to the impeller blades, as well as to improve the overall flow of debris-laden liquid through the impeller.

In a further embodiment of the invention, the impeller/stator blade interface has been contoured in a manner to significantly decrease the incidence of debris-induced blade jamming and damage. This is achieved in the present invention by altering the angle between the impeller blade exit ends and the stator blade intake ends as a function of debris size, impeller speed, liquid flow velocity, and the number of impeller and stator blades. In a preferred form only the radially-outermost portion of the impeller/stator blade interface angle is altered, corresponding to debris concentration at the interface.

The impeller/stator blade interface contour can be formed on the impeller blades only, or the stator blades only, or on both.

These and other features of the present invention will become apparent on further reading of the specification.

DETAILED DESCRIPTION OF THE DRAWINGS

Figure 1:
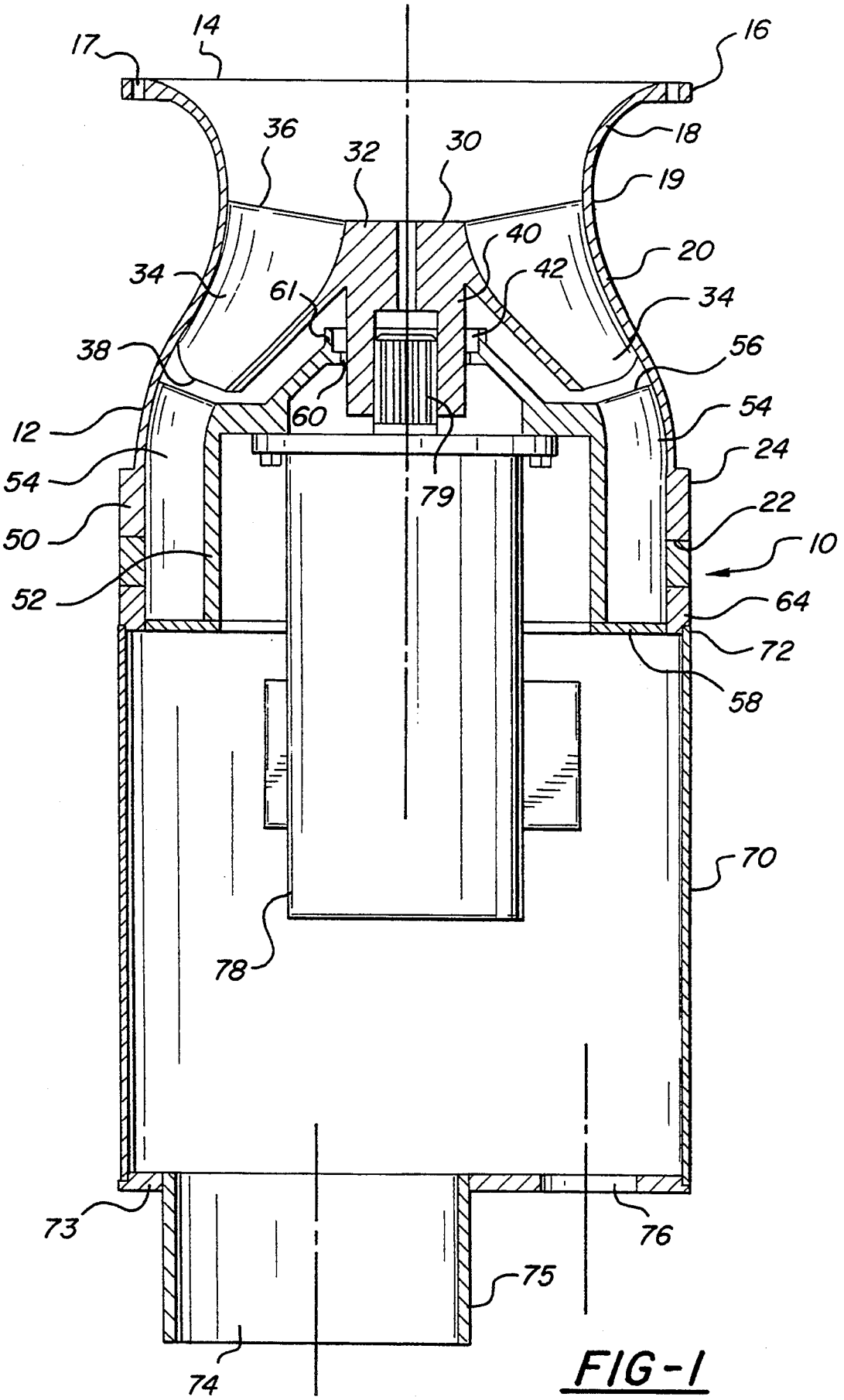
FIG. 1 is a side section view of a pump assembly according to the present invention.

Referring now to FIG. 1, a particular pump assembly according to the present invention is shown at 10. Pump assembly 10 includes a bell or venturi-shaped intake housing 12, cast or machined from suitable corrosion-resistant metal such as stainless steel. Intake housing 12 includes a circular inlet opening 14 defined by an inlet flange 16 which may include a plurality of holes 17 for attaching apparatus such as a flow straightener (not shown).

Intake housing 12 further includes a first contoured portion 18 from inlet 14 to throat 19 (the region of minimum .diameter and area in intake 12). A second contoured portion 20 is defined between throat 19 and outlet 22. Outlet 22 of intake housing 12 is itself defined by a thickened lower flange 24.

Figure 2:
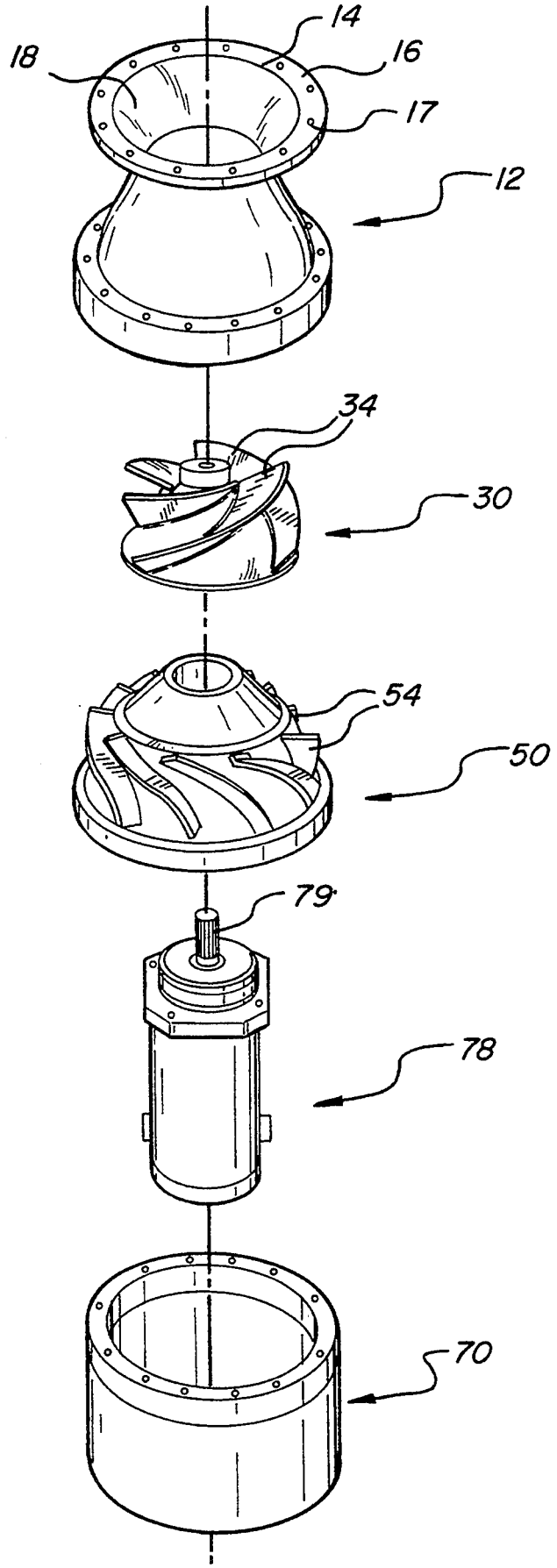
FIG. 2 is an exploded perspective view of the pump assembly of FIG. 1.

An impeller 30 is rotatably mounted in intake housing 12, impeller 30 having a frusto-conical impeller hub 32 and a plurality of integrally cast blades 34 extending in spiral fashion from the top or face 36 of impeller 30 to the impeller bottom or exit 38. The arrangement of blades 34 on impeller 30 is best shown in FIG. 2.

Impeller hub 32 includes a shaft portion 40 supporting an annular seal 42 connected in rotatable fashion to the generally cylindrical stator 50 fixedly mounted in the lower end of intake housing 12. Stator 50 includes a body or hub portion 52 having a plurality of integrally cast blades 54 extending in spiral fashion from the upper end 56 of the stator to lower end or exit 58.

Stator 50 includes an impeller shaft opening 60 including a seal seating surface 61 supporting a stationary annular seal 42. Seal 42 engages and seals the rotating impeller shaft 40.

Stator 50 is fastened to intake housing 12 by external annular flange 64 connected by bolting or other suitable method to outlet flange 24. In the illustrated embodiment of FIG. 1 the external dimensions of inlet flange 16, outlet flange 24 and stator flange 64 are identical; i.e., approximately 12 inches in diameter.

Pump assembly 10 in FIG. 1 also includes a cylindrical, hollow plenum 70 connected by welding, bolting or other suitable method to outlet flange 64 of stator 50, as for example shown at weld joint 72. Cylindrical plenum 70 includes a lower surface 73 having a cylindrical pump flow outlet 74 defined by a circular flange 75 for attachment to suitable hose or tubing which carries away the liquid pumped through assembly 10. Lower surface 73 of plenum 70 also includes an opening 76 for hydraulic supply lines (not shown).

Located within plenum 70 and partly within the interior of stator housing 50 is a hydraulic motor mechanism 78 driven by hydraulic supply lines connected to the motor through opening 76 in a known manner. Hydraulic motor mechanism 78 is connected with a suitable spline or other drive shaft 79 to impeller shaft 40 to rotate impeller 30 relative to intake housing 12 and stator 50. Hydraulic motor mechanism 78 can comprise any suitable, commercially-available hydraulic motor sufficiently sealed for operation in a liquid environment. For example, in the illustrated embodiment a vertical-axis hydraulic motor manufactured by the Eaton Corporation is used.

Referring now to FIG. 2, the components of the pump assembly of FIG. 1 are shown in an exploded, perspective view. It can be seen in FIG. 2 that the impeller blades 34 and stator blades 54 are opposed; i.e., impeller blades 34 extend spirally from top to bottom of impeller 30 in a clockwise fashion, while stator blades 54 extend from the top to bottom of stator 50 in a counter-clockwise fashion. This opposed blade arrangement removes the torque from the liquid flow forced by impeller 30 through stator 50.

The illustrated embodiment of pump assembly 10 does not show various nuts, bolts, gaskets and other detail which is known to those skilled in the art.

In accordance with the present invention, the pump assembly illustrated in FIGS. 1 and 2 is designed to efficiently pump debris-laden viscous fluids, for example crude or refined oil in the hold of a stricken or stranded oil tanker or from an oil spill. The environment of a stranded or shipwrecked oil tanker is one which poses unique problems from a pumping standpoint. The oil encountered in these situations typically contains debris such as kelp, pieces of wood, metal, gravel, plastic and petroleum solids. The viscosity of the oil being pumped can range from 5 to 500,000 centipoise; the viscosity of water is 1 centipoise.

The pump must be sufficiently lightweight and portable that it can be easily handled in the shifting and unstable confines of an unseaworthy ship, or in bad weather which may have led to the mishap. Access to the cargo hold of oil tankers is through standard 12-½ inch diameter "Butterworth" openings or hatches, limiting the pump diameter to approximately 12 inches. The pump size limitations imposed by the above factors restrict the size and power of the pump motor, which must handle a wide range of viscosities. Pump flow efficiency is therefore critical.

Of particular concern in multi-phase viscous fluid flow are the effects of viscosity and debris on flow through the pump. High viscosity multiphase flow tends to increase both cavitation and boundary layer growth along the intake surfaces, inhibiting flow. Debris in the viscous liquid further increases cavitation and boundary layer growth.

Figure 3:
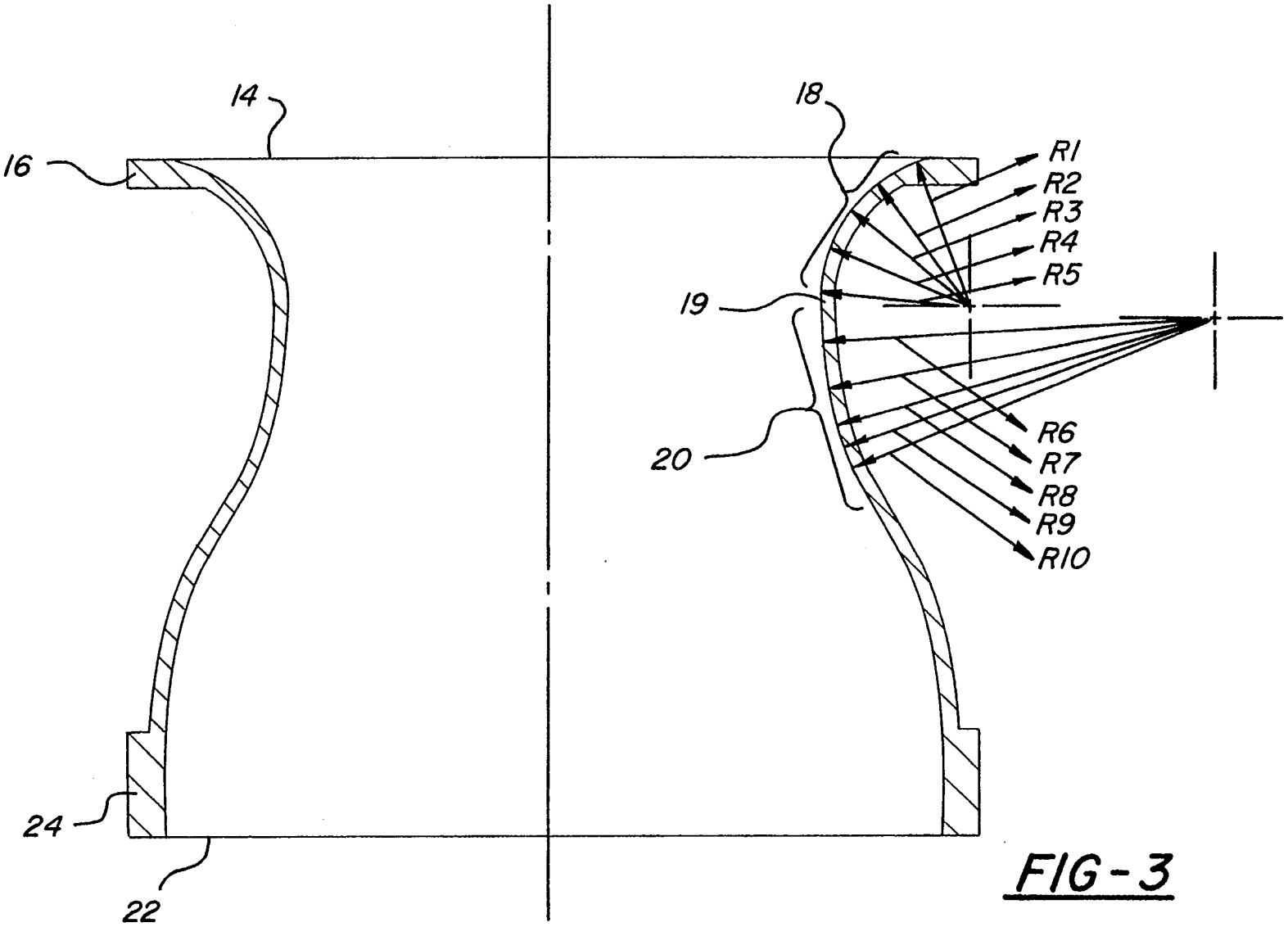
FIG. 3 is a side section view of the pump intake of FIG. 2.

To overcome or compensate for reduction in flow due to cavitation and boundary layer growth in multiphase viscous flow, the pump of the present invention is provided with a specially contoured intake housing 12, best shown in FIG. 3.

The velocity of the viscous, debris-laden oil not immediately adjacent pump inlet 14 is presumed to be zero, or near zero relative to the pump. As impeller 30 rotates to suck or pull debris-laden oil through intake 12, the oil is accelerated from low velocity at inlet 14 to high velocity at throat 19. The first problem encountered in this type of flow through the pump is cavitation at the periphery of inlet 14 adjacent flange 16 as the flow velocity of the oil increases.

Abrupt transitions or obstacles in the liquid flow path are known to create cavitation or localized separation of the flow which restricts the flow path. Accordingly, cavitation at the inlet of a pump of a given diameter reduces the effective diameter and therefore the flow through the pump. To reduce the abruptness of the transition of the liquid from the environment into the pump, pump intake inlet is "belied" or "faired" to provide a smoother, more rounded intake transition.

Once flow has entered the pump intake 12, the viscosity of the oil induces viscous boundary layer growth along the interior surfaces of intake 12. Flow velocity across the diameter of the pump is accordingly not uniform, but is rather characterized by a parabolic velocity profile in which the flow velocity at any given point along the length of the intake is slower adjacent the surface of intake 12 and faster toward the center or axis of the intake. This reduction in flow velocity toward the periphery of the pump intake effectively reduces the total mass flow through the pump as if the diameter of the pump had been reduced at that point. This reduction in effective diameter is characterized as a viscous "boundary layer".

With the pump intake of FIG. 3, the diameter of intake inlet 14 and outlet 22 are constants determined by the maximum allowable outside diameter of the pump (here, approximately 12 inches to fit standard Butterworth openings) and the thickness of flanges 16 and 24. In general, the diameters of inlet 14 and outlet 22 are as close to the maximum allowable outside diameter as possible for maximum flow through the intake. The intake diameter at throat 19 determines the maximum flow, Q, of the entire pump, since it is the narrowest, most restricted portion, and is therefore typically determined by the desired flow volume. Once the diameters of inlet 14, throat 19 and outlet 22 are determined for a desired flow Q, the contour of intake 12 between those points is variable and will affect pump efficiency.

Flow velocity is not constant through the pump intake 12, but rather increases from inlet 14 to the throat 19, and the velocity profile of the flow and the boundary layer increase correspondingly. Because the total flow Q at any point Z along the length of pump intake 12 is determined by the relationship $Q=AV$, where A equals the pump intake area at that point and V equals the flow velocity at that point, the difference between V(ideal) and V(actual) caused by the velocity flow profile and viscous boundary layer growth necessitates an increase of the intake area A at that point to achieve a desired flow Q.

In FIG. 3, the first portion 18 of pump intake 12 between inlet opening 14 and throat 19 is specially contoured in view of the above principles to reduce cavitation and to compensate for viscous boundary layer growth. To reduce cavitation it has been empirically determined that the minimum or starting radius $R_1$ of contoured portion 18 should be equal to or greater than the axial distance $D_t$ from inlet 14 to throat 19. This constant initial radius $R_1$ of intake 12 significantly reduces cavitation effects in multi-phase viscous flow. In the illustrated embodiment of FIG. 3, $D_t$ and $R_1$ are equal, approximately 2.14".

While setting the radius $R_1$ of first contoured portion 18 equal to or greater than $D_t$ greatly reduces cavitation encountered in multi-phase viscous flow, the efficiency of the pump can be further improved by decreasing $R_1$ (and correspondingly increasing the intake area at that point) in response to viscous boundary layer growth along contoured portion 18. In the illustrated embodiment of FIG. 3, this is shown by the non-continuous radius decrease $R_2$–$R_5$ along the first contoured portion 18, decreasing from the inlet end to throat 19 such that $R_1>R_2>R_3>R_4>R_5$. In the illustrated embodiment $R5=2.05''$ approximately.

The velocity profile along the interior of intake 12 is determined by the equation $$V_z(r)/V_{actual}=(a/b)(1-r)_n$$

where $V_z$ equals the flow velocity at point z along the intake 12; r is a radius ratio of the intake diameter at point Z; $V_{actual}$ equals the average flow velocity at point z; a/b is a constant based on viscosity and debris loading, readily determinable by those skilled in the art of fluid flow; and n is a constant based on viscosity and intake length, also readily determinable by those skilled in the art. In the illustrated embodiment of FIG. 3 for viscous fluid flow a/b is=1.8 and n=1/7 along first contoured portion 18.

Using the above nth power law the radius decrease $R_2-R_5$ can be determined for first contoured portion 18.

Flow across the second contoured portion 20 of intake 12 in the region of impeller 30 is also subject to viscous boundary layer growth. The second contoured portion 20 is given an initial radius $R_6$ greater than the axial distance $D_i$ from the impeller blade face 36 to impeller blade exit 38. The distance $D_i$ essentially corresponds to the distance between the intake throat 19 and the impeller exit; this is the area in which impeller-generated forces affect boundary layer growth and velocity profile. In the illustrated embodiment $R_6=5.50''$ approximately.

The radius $R_6$ in second contoured region 20 corresponding to impeller 30 is a flow expanding radius designed to reduce cavitation in the impeller region. In accordance with the present invention, it is further desirable to decrease radius $R_6$ in the second contoured region 20 to compensate for boundary layer growth. This decrease is shown as radii $R_7-R_{10}$, where $R_6>R_7>R_8>R_9>R_{10}$. $R_{10}=5.36''$ approximately in the illustrated embodiment.

While the same flow velocity profile equation is used to determine radius $R_7-R_{10}$, the constants a/b and n are different. In the illustrated embodiment, a/b for determining boundary layer growth in second contoured portion 20 is 1.2, while n is $\frac{1}{4}$. This difference in coefficients is due to the impeller-and debris-generated boundary layer growth factors in the second contoured region 20. Specifically, the flow in region 20 has a substantial radial component due to the rotating impeller 30, tending to increase the boundary layer growth along the walls. More importantly, impeller 30 is designed to force or concentrate the debris radially outward adjacent the surface of intake 12, greatly increasing boundary layer growth in region 20. Recognition of these factors, peculiar to multi-phase viscous flow in an axial flow pump, is important to the present invention.

It will be apparent to those skilled in the art that the above-determined coefficients for boundary layer growth may vary depending on the liquid being pumped, the amount and size of debris expected, the size and dimensions of the pump components, the direction of flow, and other factors. The coefficients and radius dimensions listed above are an illustrated embodiment for a particular set of flow parameters. It is the broader concept of setting initial radii $R_1$ and $R_6$ in regions 18 and 20 of the intake proportional to fixed intake parameters, and subsequently modifying those radii in view of viscous boundary layer growth parameters unique to regions 18 and 20 in an axial flow pump, which are part of the present invention.

Still referring to FIG. 3, the remainder of intake housing 12 below second contoured portion 20 has an inverse radius essentially identical to but inverse with respect to $R_6-R_{10}$. This region of intake 12 is less critical than regions 18 and 20 controlling flow, although it is preferable to form it as the inverse of region 20 to reflect the deceleration of the flow after leaving the impeller. It is also limited, of course, by the dimensions of the outlet 22.

In FIG. 1, a further debris-handling feature of the present invention is shown as an extremely close fit between impeller blades 34 and the interior surface of pump intake 12. In the illustrated embodiment the gap between impeller blades 34 and the surface of intake 12 is on the order of 0.007 inches. While this tolerance may vary somewhat, it is set according to the present invention substantially smaller than the smallest size or diameter of debris expected to be encountered in a multi-phase flow pumping situation. Although the prior art teaching has been to increase the gap between impeller blades 34 and the surface of intake 12 to accommodate debris and prevent jamming between the impeller 34 and intake 12, it has been found that the close fit and minimal tolerance between impeller 34 and intake 12 actually reduces the frequency of debris-jamming therebetween. Instead, debris is forced to remain within the radial confines of impeller blades 34 and is channeled efficiently therethrough to the stator and pump outlet.

Figure 4:
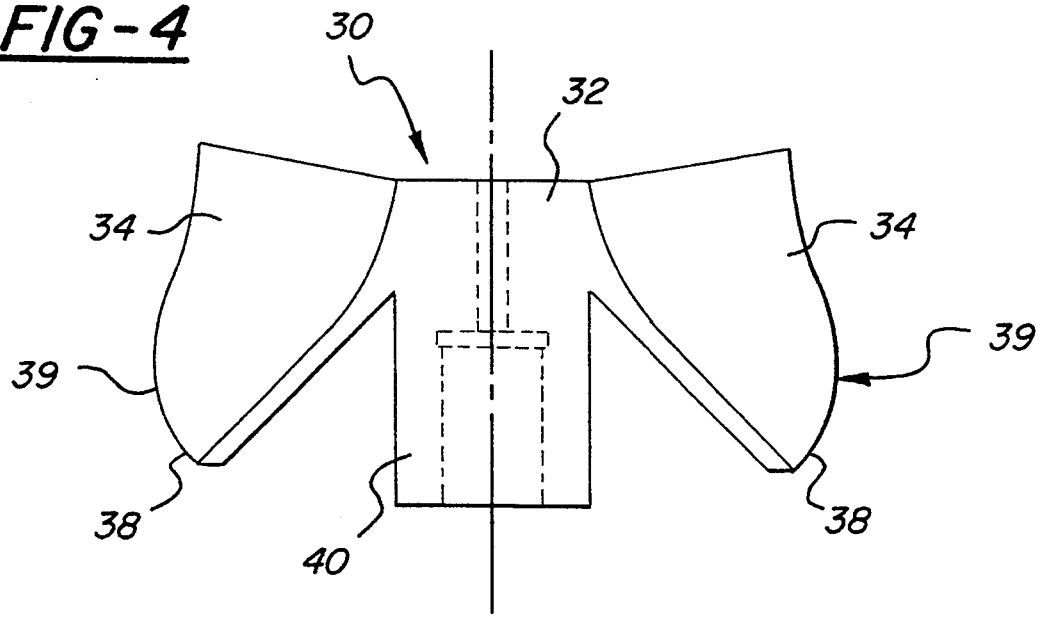
FIG. 4 is a side section view of the pump impeller of FIG. 2.

Referring now to FIG. 4, impeller 30 is shown apart from the main pump assembly 10. As noted above, it is desirable in the present invention to force the multi-phase flow radially outward to concentrate it near the periphery of the impeller. This is achieved in part by "dishing" impeller blades 34 such that their upper surfaces are concave in cross-section. The dished upper surface of impeller blades 34 increases the radial velocity of debris as compared to a flat, planar blade surface.

Accordingly, by the time the flow reaches the lower or exit end 38 of impeller 30, the debris is largely concentrated on the peripheral tip 39 of exit ends 38 of impeller blades 34. It is in this region that impeller blades 34 are given an upwardly-angled, swept-back contour to alter the impeller/stator blade interface to resist jamming and blade damage from debris caught between the impeller and stator.

Figure 5:
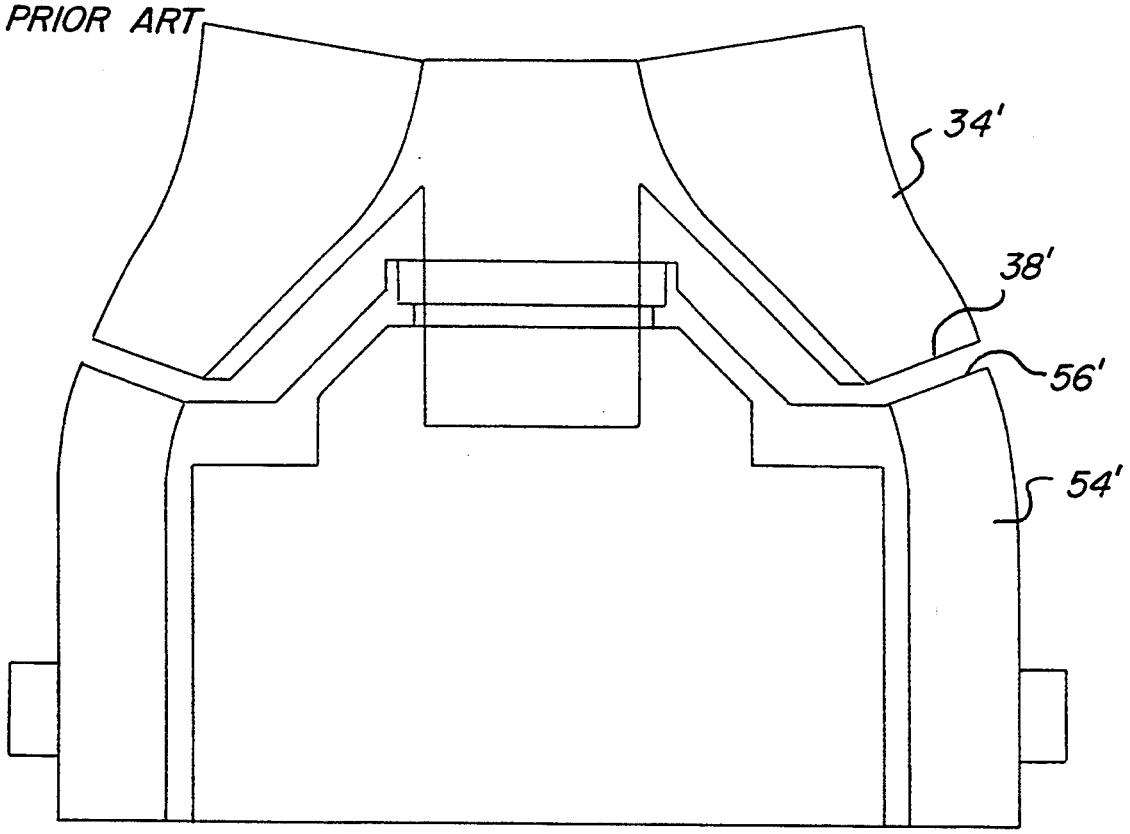
FIG-5 PRIOR ART
FIG. 5 is a side section view of a prior art impeller/-stator blade interface.

Referring now to FIG. 5, a typical prior art impeller/stator blade interface is schematically shown, defined by straight, parallel impeller blade ends 38' and stator blade faces 56'. In the prior art, it is considered desirable to match impeller blade ends 38' and stator blade faces 56' in parallel fashion with minimal spacing between them such that, when the impeller and stator blades 34', 54' are in rotational alignment, they form an essentially continuous, aligned blade. This is the optimum configuration for axial flow efficiency; i.e., the angles of impeller blade ends 38' and stator blade faces 56' are parallel to form a nearly continuous blade surface and a uniform blade interface when they are aligned.

However, the prior art impeller/stator blade interface of FIG. 5 does not take into account the type or location of debris encountered in multi-phase flow through an axial flow pump. The close fit or tolerance between impeller blade ends 38' and stator blade faces 56' in FIG. 5, along with their perpendicular shear angle, tends to trap debris at the impeller/stator blade interface and subsequently jam or otherwise damage the pump assembly.

Figure 6:
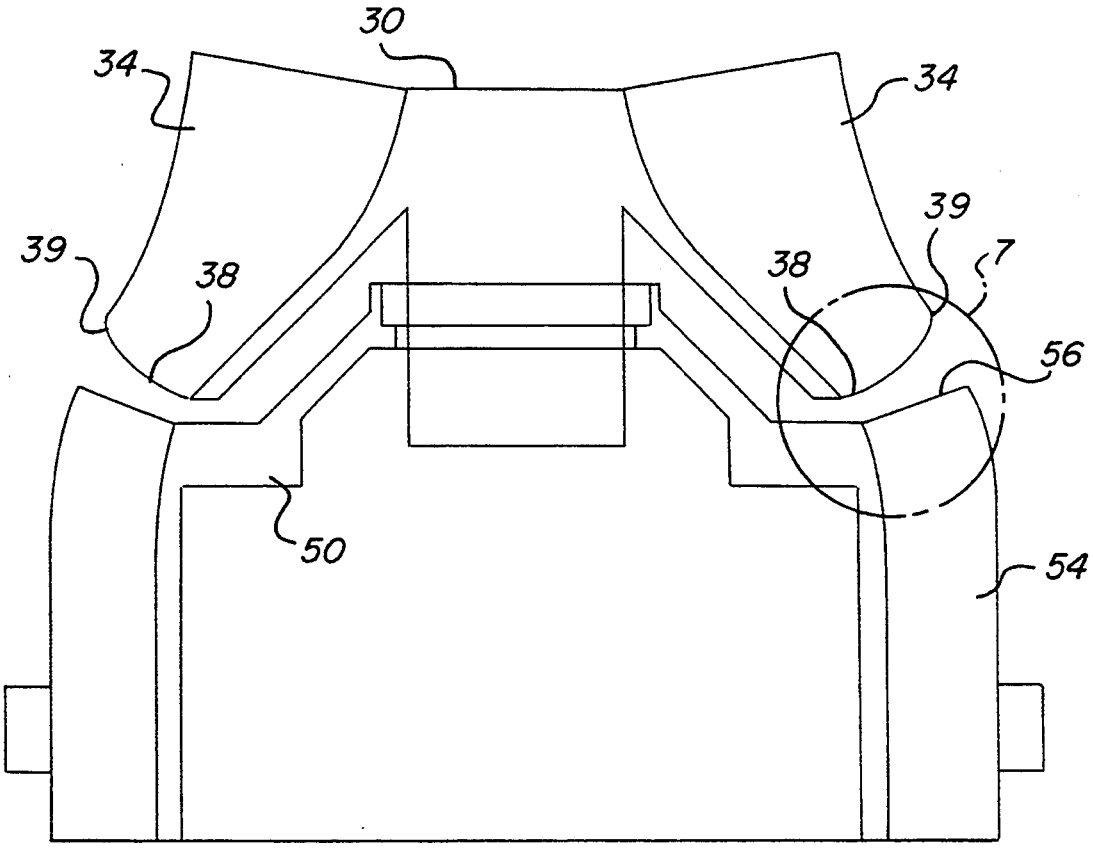
FIG. 6 is a side section view of an impeller/stator blade interface according to the present invention.

Referring now to FIG. 6, the impeller/stator blade interface of the present invention is shown with the angle of the radially-outermost portion of the interface increased at contoured impeller blade portions 39.

Impeller blade tip portions 39 are angled both up and back relative to the interior portion 38 for a curved, swept-back tip contour. This contour change in the region corresponding to the latter phase of debris flow through impeller 30, specifically where debris is concentrated in the flow, substantially reduces the likelihood of debris being caught or jammed at the impeller/stator blade interface. In the illustrated embodiment of FIG. 6, portion 39 is angled up with respect to portion 38 at approximately 28°, and swept back with an approximate radius of 0.5".

Figure 7:
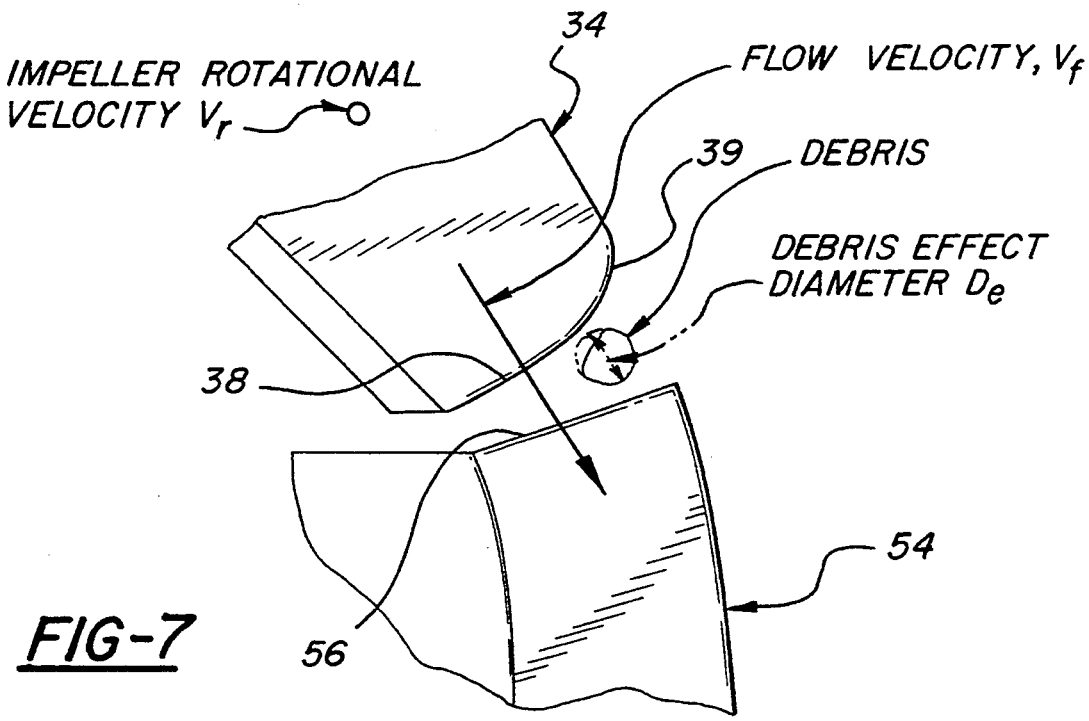
FIG. 7 is an enlarged view of an impeller/stator blade interface according to FIG. 6.

As illustrated in FIG. 7, factors affecting the impeller/stator blade interface contour 39 are the impeller rotational speed $V_r$, which sets the radial velocity of debris as it leaves the impeller; the axial flow velocity $V_f$ of the liquid carrying the debris; the number of impeller and stator blades; and, the maximum expected debris size $D_e$.

In general, impeller blade ends 38 are contoured at 39 such that the impeller/stator blade interface gap corresponding to radially-outward portions 39 is greater than the maximum expected debris diameter $D_e$. However, the angularity of contoured portions 39 and the gap corresponding thereto at the periphery of the impeller/stator blade interface can be increased or decreased depending on other factors. For example, the faster the impeller rotational velocity $V_r$, the greater the angularity of portion 39 to prevent the debris from being struck by a subsequent impeller blade as it crosses the impeller/stator interface. The faster the axial flow velocity $V_f$, the smaller the angularity of contoured blade portion 39 because the debris will cross the impeller/blade interface faster and be exposed to jamming for a shorter period of time.

The contour 39 can be a straight line contour or angle not parallel to stator blade face 56, or, as shown in the drawings, additionally curved back opposite the direction of impeller rotation. The curved contour is more effective to prevent damage; the straight contour is less expensive to machine on impeller ends 38.

The impeller/stator blade interface of the present invention is far less likely to become jammed during multi-phase flow than prior art interfaces as shown in FIG. 5. Moreover, loss of axial pumping efficiency is slight since the angular increase in the impeller/stator blade interface is formed at a radially outward portion of the interface where the debris is concentrated by the impeller.

Although in the illustrated embodiment the inventive impeller/stator blade interface contour is achieved by altering the contour of the impeller blade ends 38 at portions 39, it will be apparent to those skilled in the art that the inventive impeller/stator blade interface can also be achieved by contouring the stator blade faces 56 only, or both the impeller ends 38 and stator blade faces 56 in complementary fashion.

Figure 8:
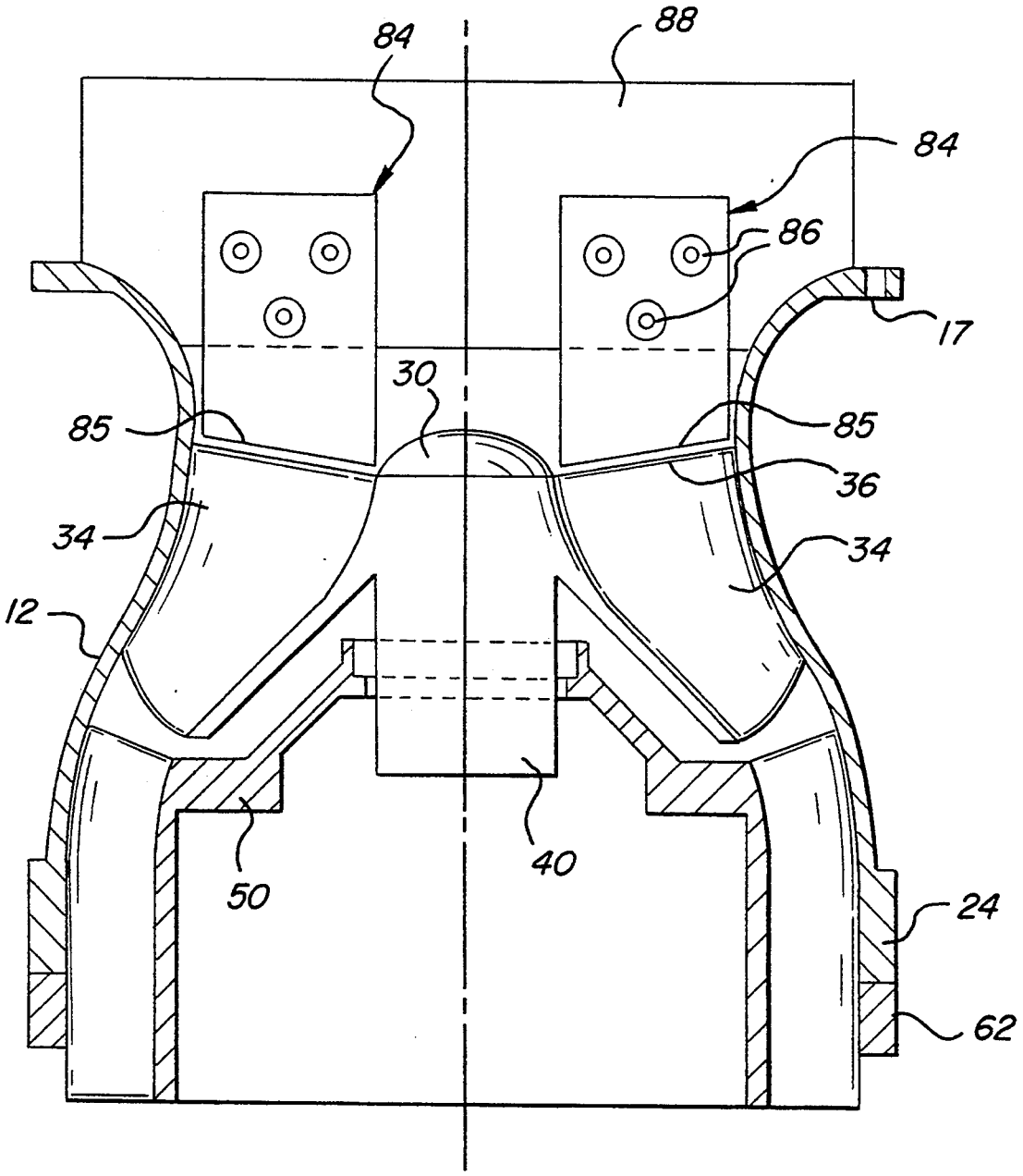
FIG. 8 is a side section view of the pump assembly of FIG. 1, including a debris-cutting or shearing mechanism.

Referring now to FIG. 8, the pump assembly 10 of FIG. 1 is shown with an added debris-handling feature of cutting blades 84 bolted or otherwise connected at 86 to an intake flow straightener 88 mounted in the inlet 14 of intake 12. Flow straightener 88 is a device which is known in the art for improving the flow direction of oil entering the pump intake, and comprises a plurality of radially spaced, straight fins. Cutter blades 84, however, are novel.

Cutting blades 84 comprise straight, planar metal bodies having beveled and sharpened blade ends 85 positioned just above the impeller blade faces 36. Cutting blade faces 85 are essentially parallel to impeller blade faces 36 and are fixed relative thereto, such that kelp, plastic, rope and other debris capable of being cut which may be sucked into intake 12 is caught and sliced between blade faces 85 and impeller faces 36 as it is spun by the impeller. Cutting blades 84 do not adversely affect the debris-handling features of pump assembly 10. The wide mouth or intake at impeller face 36 between each of the impeller blades 34, and the relatively thin and flexible cutting blades 84 reduce the possibility of non-shearable debris becoming jammed at their interface.

The illustrated embodiments above are not intended to be limiting, as it will be apparent to those skilled in the art that modifications to the specifically illustrated structure can be made and still lie within the scope of the appended claims.

I claim:

1. A hydraulically-driven, axial flow pump for pumping viscous liquids, particularly debris-containing or multi-phase flow, comprising:

a venturi-shaped intake having an inlet, a throat of minimum area, and an outlet;

a rotating impeller mounted in the intake, the impeller having a plurality of blades defining a first interface at the intake throat;

a fixed stator mounted in the intake between the impeller and the outlet, the stator coaxial with the impeller and having a plurality of stator blades;

an impeller/stator interface defined between the impeller and stator blades;

means connected to the impeller to rotate the impeller and force oil through the pump from the inlet to the outlet; wherein, the pump intake has a first contoured portion from the inlet to the throat having an initial radius of curvature equal to or greater than the axial distance from the intake inlet to the throat radius, and a second contoured surface portion from the throat to the impeller blade exit having a second initial radius of curvature greater than the axial distance from the throat to the impeller exit.

2. Apparatus as defined in claim 1, wherein the radius of curvature of the first contoured portion decreases from the inlet toward the impeller in proportion to viscous boundary layer growth along its length.

3. Apparatus as defined in claim 2, wherein the radius of curvature of the second contoured portion decreases from the throat to the impeller blade exit in proportion to viscous boundary layer growth along its length.

4. Apparatus as defined in claim 1, wherein the impeller/stator interface is contoured at a portion thereof corresponding to the flow of debris at the interface to increase the angle and spacing of the impeller/stator interface at that portion.

5. Apparatus as defined in claim 4, wherein lower, radially-outward edge portions of the impeller blades are angled in at least one plane to increase the width of the impeller/stator interface at a radially-outward portion thereof.

6. Apparatus as defined in claim 5, wherein the lower, radially-outward edge portions of the impeller blades are curvingly contoured up and back relative to the interface and the direction of rotation of the impeller.

7. Apparatus as defined in claim 1, wherein the impeller blades are spaced radially from the intake surface a distance substantially less than the size of the smallest debris expected in multiphase flow.

8. An axial flow pump for pumping viscous liquids, particularly debris-containing or multiphase flow, comprising:

a venturi-shaped intake having an inlet, a throat, and an outlet;

a rotating impeller mounted in the intake, the impeller having a plurality of blades defining a first interface at the intake throat;

a fixed stator mounted in the intake between the impeller and outlet, the stator coaxial with the impeller and having a plurality of stator blades;

impeller/stator interface defined between the impeller and stator blades;

means connected to the impeller to rotate the impeller and force oil through the pump from the inlet to the outlet; wherein, the pump intake has a first contoured portion from the inlet to the throat with a first initial radius at least equal to the axial distance from the intake inlet to the throat, and a second contoured portion from the throat to the impeller blade exit having a second initial radius greater than the axial distance from the throat to the impeller exit, the radius of the first contoured portion decreasing from the inlet to the throat in proportion to viscous boundary layer growth along the first contoured portion, and the radius of the second contoured portion decreasing from the throat to the impeller exit in proportion to viscous boundary layer growth along the second contoured portion, the initial radius of the second contoured portion substantially greater than the initial radius of the first contoured portion.

9. Apparatus as defined in claim 8, wherein the impeller/stator interface is contoured at a radially-outward portion thereof corresponding to the flow of debris at the interface to increase the angle and spacing of the impeller/stator interface at that portion.

10. Apparatus as defined in claim 9, wherein lower, radially-outward edge portions of the impeller blades are angled in at least one plane to increase the width of the impeller/stator interface at a radially-outward portion thereof, while the angle and spacing of a remainder of the lower edge portions of the impeller blades are minimized relative to the stator blades.

* * * * *

UNITED STATES PATENT AND TRADEMARK OFFICE

CERTIFICATE OF CORRECTION

PATENT NO. : 5,385,447

DATED : January 31, 1995

INVENTOR(S) : Geister

It is certified that error appears in the above-indentified patent and that said Letters Patent is hereby corrected as shown below:

Column 1, line 13, delete "and thee" and insert --and the--;

Column 3, line 26, delete "of minumum." and insert --of minimum--;

Column 5, line 4, delete "belied" and insert --belled--;

Column 5, line 67, delete "$R_2$_$R_5$" and insert --$R_2$-$R_5$--;

Column 6, line 11, delete "z" and insert --Z--.

Signed and Sealed this

Twenty-third Day of May, 1995

Bruce Lehman

*Attest:*

BRUCE LEHMAN

*Attesting Officer*

*Commissioner of Patents and Trademarks*